US007404367B2

(12) United States Patent
Yasuzawa

(10) Patent No.: US 7,404,367 B2
(45) Date of Patent: Jul. 29, 2008

(54) STITCH STRUCTURE

(75) Inventor: Osamu Yasuzawa, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 136 days.

(21) Appl. No.: 11/519,925

(22) Filed: Sep. 13, 2006

(65) Prior Publication Data

US 2007/0056491 A1 Mar. 15, 2007

(30) Foreign Application Priority Data

Sep. 14, 2005 (JP) ..... 2005-267281

(51) Int. Cl.
*D05B 1/10* (2006.01)
*D05B 65/00* (2006.01)

(52) U.S. Cl. ..... 112/197; 112/291

(58) Field of Classification Search ..... 112/197, 112/165, 291, 292, 293, 296, 298, 475.01, 112/475.17; 83/910, 936
See application file for complete search history.

(56) References Cited

U.S. PATENT DOCUMENTS 3,532,065 A * 10/1970 Marforio ..... 112/292
4,726,305 A * 2/1988 Seto ..... 112/298
5,722,338 A * 3/1998 Douyasu ..... 112/475.17
5,769,018 A * 6/1998 Nakano ..... 112/475.17
6,119,613 A * 9/2000 Douyasu et al. ..... 112/475.17
6,422,165 B1 * 7/2002 Tanaka et al. ..... 112/470.01

FOREIGN PATENT DOCUMENTS

JP 6-182079 A 7/1994
JP 2879399 B2 1/1999
JP 3673902 B2 5/2005

* cited by examiner

*Primary Examiner*—Ismael Izaguirre
(74) *Attorney, Agent, or Firm*—Birch, Stewart, Kolasch & Birch, LLP

(57) ABSTRACT

A stitch structure capable of effectively preventing the occurrence of raveling peculiar to double chain stitches irrespective of sewing conditions is provided by the stitch structure of double chain stitches including a plural number of needle threads forming rows of thread loops at the rear face of a cloth and one looper thread entwined with the rows of thread loops at the rear face of the cloth;

wherein the looper thread is cut at one side of the positions at which it is entwined in the mode of interlacing with the preceding loops preceding to the final loops at the respective sewing termination ends of the respective rows of thread loops.

6 Claims, 10 Drawing Sheets

STITCH STRUCTURE

CROSS-REFERENCE TO RELATED APPLICATIONS

This Nonprovisional application claims priority under 35 U.S.C. §119(a) on Patent Application No. 2005-267281 filed in Japan on Sep. 14, 2005, the entire contents of which are hereby incorporated by reference.

BACKGROUND OF THE INVENTION

1. Field of the Invention

The present invention relates to a stitch structure of double chain stitches formed in sewing products using a sewing machine, and specifically relates to a stitch structure for preventing raveling stitches caused at the end portion of stitching.

2. Description of Related Arts

Stitch structures with various modes are put into practical use so as to be suitable for types and parts of sewing products especially in the sewing using a sewing machine for industrial use. As one of these stitch structures, there is a stitch structure of double chain stitches that is represented by a D code in the Japanese Industrial Standards and further, there is also a stitch structure of flat seam stitches that is represented by the F code of the Japanese Industrial Standards and added with covered stitches with an upper cover thread to the double chain stitches.

FIG. 1 is the illustration diagram of the stitch structure of double chain stitches which indicates stitches, which appear on both faces of a cloth. As shown in the drawing, the stitches of the double chain stitches are arranged mutually in parallel on the surface 10 of the cloth 1 and composed of a plural number of needle threads 2 and 2—(3 threads in the diagram) which penetrate the cloth 1 with a pitch corresponding to a feed quantity and one looper thread 3 entwined with these needle threads 2 and 2—at the rear face 11 of the cloth 1. Further, an outline arrow mark in the diagram shows the feed direction of the cloth 1.

The needle threads 2 and 2—form respectively loops at the penetration positions at the rear face 11 of the cloth 1 and these loops form rows of thread loops 20 and 20—that are arranged to the feed direction of the cloth 1. The looper thread 3 is unreeled along the rear face 11 of the cloth 1 in a direction nearly orthogonal to the fore-mentioned feed direction and entwined with the rows of thread loops 20 and 20—to form the stitches of the double chain stitches as illustrated.

FIG. 2 is a plan view showing a state in which the needle threads are entwined with the looper thread at the rear face of the cloth. The present diagram shows the stitch structure of double chain stitches with two needles. The looper thread 3 is entwined with respective loops of the rows of thread loops 20 and 20 which the two needle threads 2 and 2 form respectively by interlooping and interlacing as illustrated in the drawing and these needle threads 2 and 2 and the looper thread 3 are collectively cut at the sewing end portion to form the stitches. However, in the stitches, since the terminal cutting portion 3*a* of the looper thread 3 is situated at one side of the positions at which the looper thread 3 is entwined with the final loops 2*a* and 2*a* of the rows of thread loops 20 and 20 in the mode of the interlooping, the looper thread 3 is slipped off from the final loops 2*a* and 2*a* of the rows of thread loops 20 and 20 when the terminal portion 3*a* of the cutting portion is pulled as shown in FIG. 2 by an arrow, and there is a problem that the slipping-off is transferred to the loop of the sewing start side (the upper side of the drawing) of the rows of thread loops 20 and 20 one after another and the stitches are raveled;

Methods of preventing raveling stitches have been conventionally proposed variously. As one of those methods, there is a method disclosed in Japanese Patent Publication No. 2879399 by the applicant of the present invention. It is a method by which when a looper for reeling out a looper thread is situated nearby a proceeding end just before the termination of sewing, the looper thread is retained at the rear side of the looper and the needle threads and the looper thread are cut after carrying out one stroke of sewing motion in this state.

FIG. 3 is a plan view of the stitch structure obtained by the method. According to the method, the looper thread 3 retained just before the termination of sewing is cut at a position at which it is pulled out from the loop 2*a* of one side (at the right side of the drawing and at the left side viewed from the front of a sewing machine) of the positions at which it is entwined with the final loops 2*a* and 2*a* of the rows of thread loops 20 and 20 in the mode of the interlacing, so that the stitch shown in the drawing is obtained. In this case, even if the terminal cutting portion 3*a* of the looper thread 3 is pulled as shown by an arrow in the drawing, the looper thread 3 is not slipped off from the final loops 2*a* and 2*a* of the rows of thread loops 20 and 20 entwined in the mode of the interlacing and the raveling stitches can be surely prevented at the stage they start.

Further, the prevention of raveling by the stitch structure shown in FIG. 3 is realized on the assumption that a state in which the looper thread 3 is entwined with the final loops 2*a* and 2*a* of the rows of thread loops 20 and 20 in the mode of the interlacing. However, since slack is liable to occur in the final loops 2*a* and 2*a* formed at the portion of termination of sewing, there is a fear that the looper thread 3 entwined with these loops 2*a* and 2*a* are slipped out to the direction of external force when the external force is applied to a direction shown by an outline arrow in FIG. 3. Since the stitches after the occurrence of slipping is the same as the stitches shown in FIG. 2, the extension of the raveling to the sewing start side cannot be stopped.

Hereat, the strength of the tension of the needle threads 2 and 2 forming the rows of thread loops 20 and 20 is selected in accordance with the coordination with the cloth 1. For example, when soft cloth or thin cloth is sewed, the tension of the needle threads 2 and 2 is often weakened for improving the quality of sewing products. Further, the kind of the needle threads 2 and 2 forming the rows of thread loops 20 and 20 is also selected in accordance with the sewing products and for example, smooth needle threads 2 and 2 are often used in sewing products thinking a great deal of the feel on the skin of a user. The fore-mentioned slack of the final loops 2*a* and 2*a* occurs easily when sewing is carried out under weak tension using the smooth needle threads 2 and 2.

BRIEF SUMMARY OF THE INVENTION

The present invention was carried out under these circumstances and it is the purpose of the present invention to provide a stitch structure capable of effectively preventing the occurrence of raveling peculiar to double chain stitches (including flat seam stitches) irrespective of sewing conditions such as the kind of thread and its tension.

The stitch structure related to the first invention of the present invention is a stitch structure of double chain stitches comprising: a plural number of needle threads penetrating a cloth and respectively forming rows of thread loops at the rear face of the cloth and one looper thread entwined with the rows of thread loops at the rear face of the cloth; wherein the looper thread is cut at one side of the positions at which it is entwined in the mode of interlacing with preceding loops adjacent to final loops at the respective sewing termination ends of the plural number of rows of thread loops or the preceding loops adjacent to the final loops at an interval.

The stitch structure related to the second invention of the present invention is characterized in that the looper thread is entwined in the mode of interlacing between the final loops in the first invention and the preceding loops and cut at both ends.

The present invention-provides the stitch structure in which the looper thread is cut at one side of the positions at which it is entwined in the mode of interlacing with not the final loops at a sewing termination end but the preceding loops adjacent to the final loops on the preceding side (sewing starting side) and it is less liable cause slack in comparison with the final loops; therefore the cutting portion is tightly retained and the occurrence of raveling caused by the slipping off of the cutting portion is surely prevented irrespective of sewing conditions. When the looper thread is thus cut, the fragment of the looper thread whose both ends were cut between the cutting portion and the final cutting portion remains between the final loop of the rows of thread loops in a state in which it is entwined in the mode of double chain stitches.

The stitch structure related to the third invention of the present invention is characterized in that a pitch between the final loops and the preceding loops is smaller than a pitch between loops previous to the preceding loops.

The stitch structure related to the fourth invention of the present invention is characterized in that a pitch between the final loops and the preceding loops and at least one pitch between loops further previous to are smaller than pitches between loops further previous to the preceding loops.

In these inventions, the interloop pitches are differed between the loops previous to and subsequent to the loops corresponding to the cutting position of the looper thread and the pitch at the sewing termination side is lessened; and thereby, the slipping off of the looper thread or the slipping off of the fragment of the looper thread is surely prevented by reinforcing the entwinement of the looper thread with needle threads.

The above and further objects and features of the invention will more fully be apparent from the following detailed description with accompanying drawings.

DETAILED DESCRIPTION OF THE PREFERRED EMBODIMENTS

The present invention is specifically illustrated below based on the drawings showing the embodiments.

Figure 4:
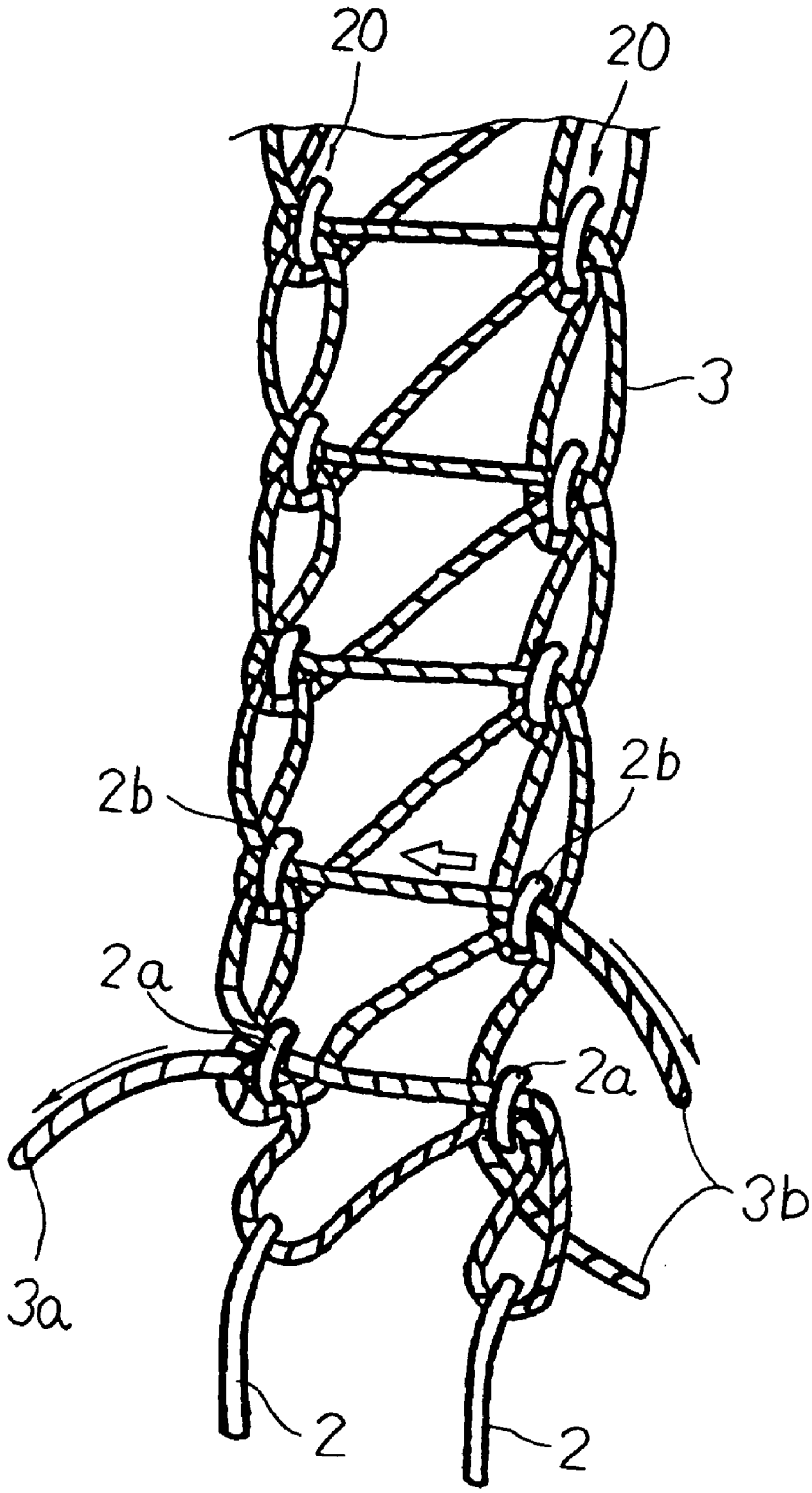
FIG. 4 is a plan view showing the first embodiment of the stitch structure related to the present invention.
Figure 5:
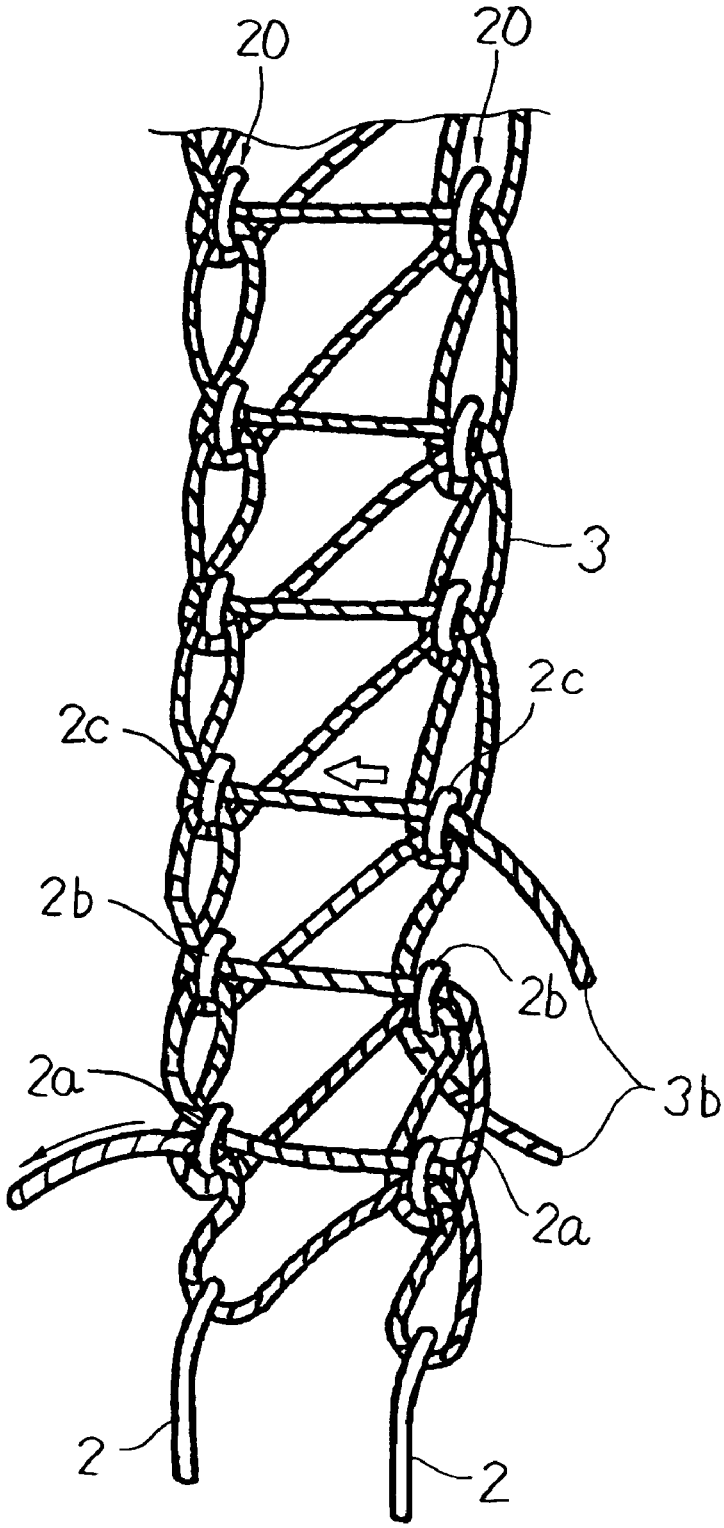
FIG. 5 is a plan view showing the second embodiment of the stitch structure related to the present invention.

FIG. 4 is a plan view showing the first embodiment of the stitch structure related to the present invention. FIG. 5 is a plan view showing the second embodiment of the stitch structure related to the present invention and shows stitches appearing nearby the sewing termination portion at the rear face of a cloth in a magnified form.

Figure 1:
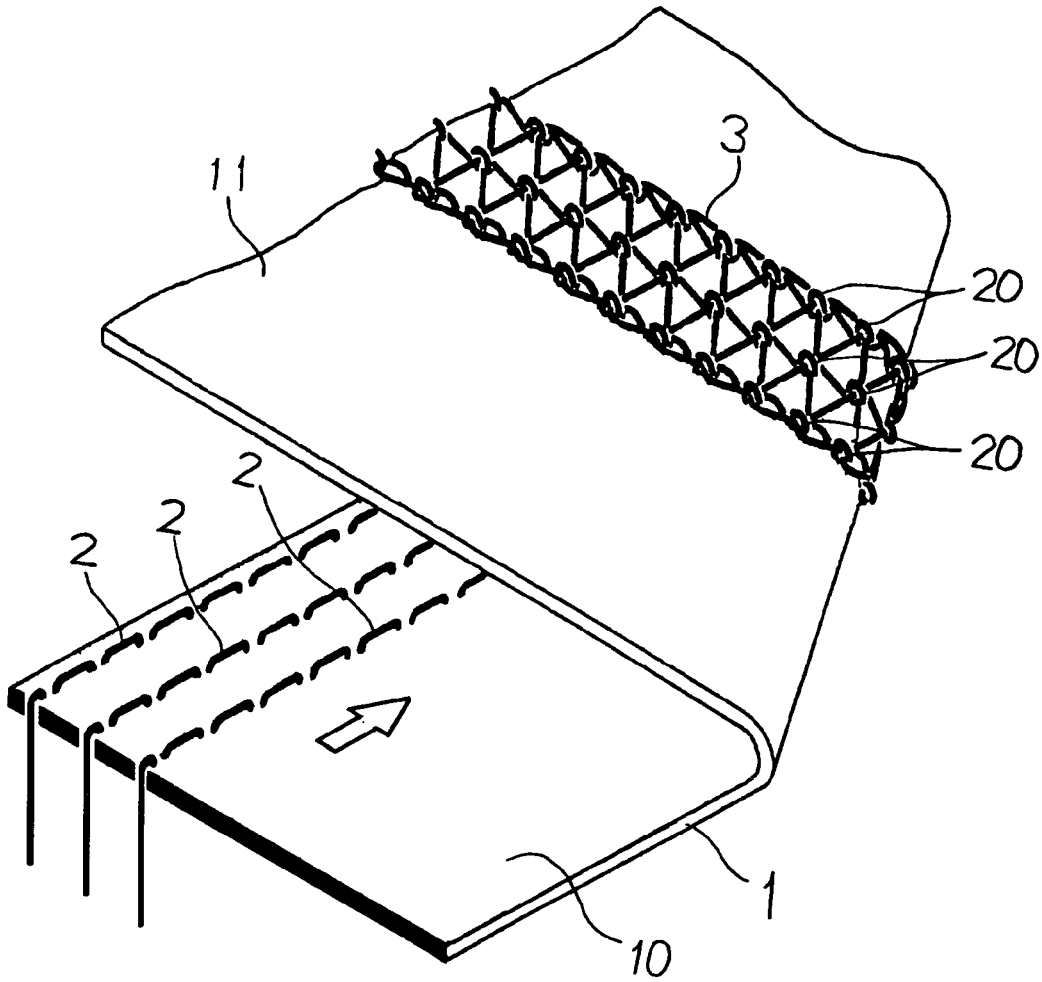
FIG. 1 PRIOR ART
FIG. 1 is an illustration diagram of the stitch structure of double chain stitches.
Figure 2:
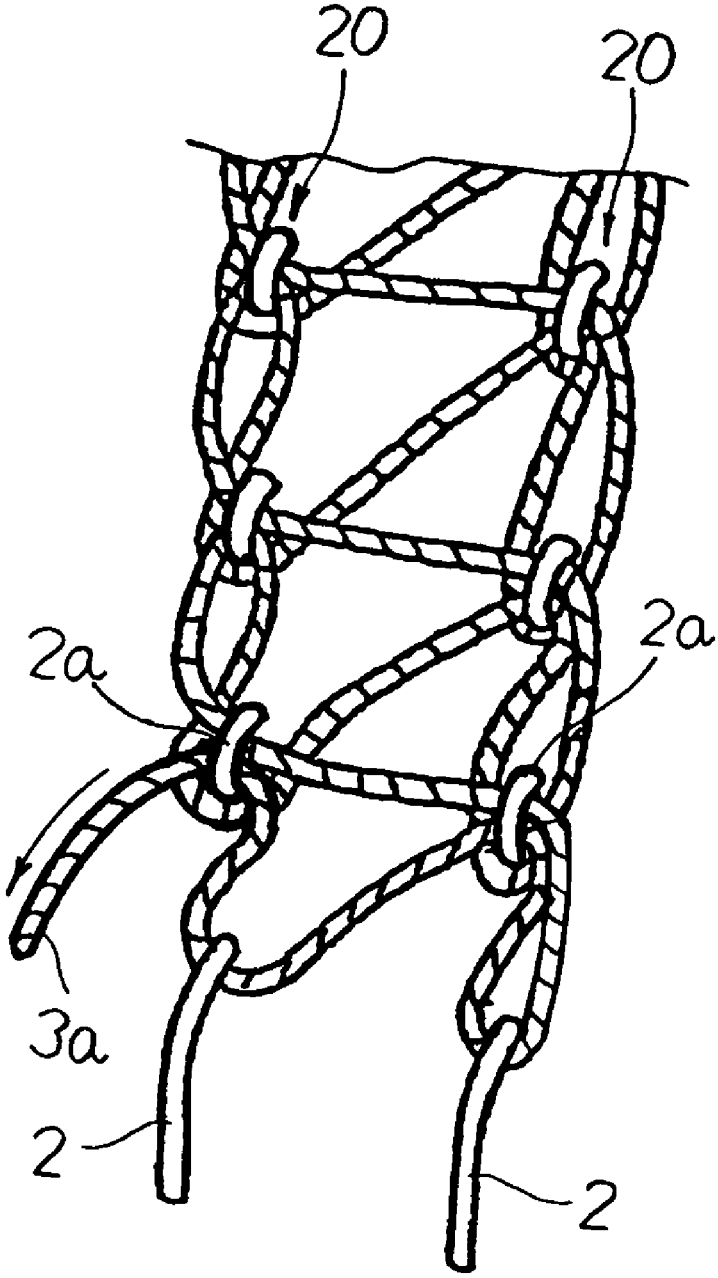
FIG. 2 PRIOR ART
FIG. 2 is a plan view showing a state in which a needle thread is entwined with a looper thread at the rear face of a cloth.
Figure 3:
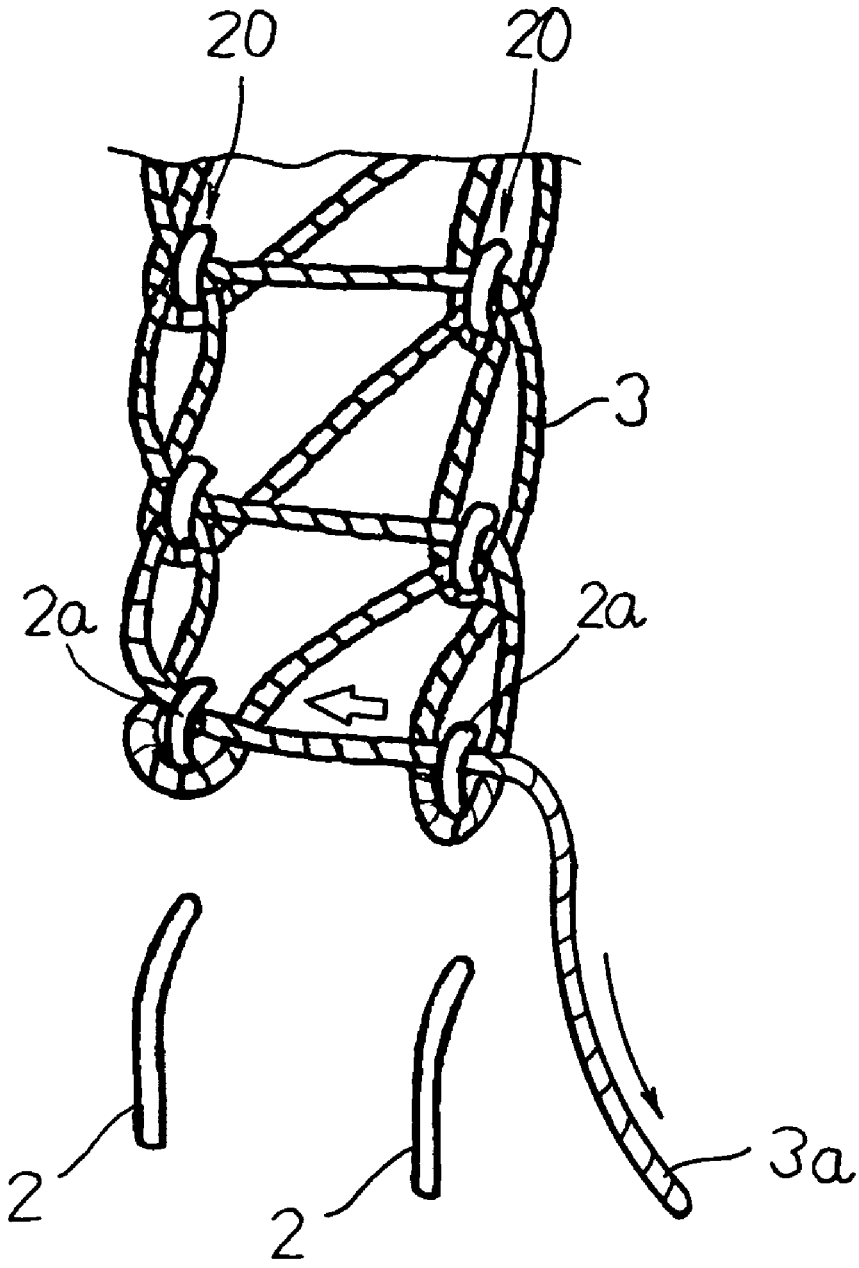
FIG. 3 PRIOR ART
FIG. 3 is a plan view of the stitch structure obtained by a conventional method of preventing raveling.

The stitch structures shown in FIGS. 4 and 5 are the stitch structures of double chain stitches with two needles, in like manner as the stitch structure shown in the fore-mentioned FIG. 2, in which the looper thread 3 is entwined with the two rows of thread loops 20 and 20 formed by two needle threads 2 and 2 arranged mutually in parallel in the modes of interlooping and interlacing.

The looper thread 3 is reeled out by a looper (not illustrated) which advances toward the right side in FIGS. 4 and 5 and, recedes toward the left side, entwined with the final loops 2*a* and 2*a* of the respective rows of thread loops 20 and 20 in the mode of interlacing at the sewing termination portion which is shown at the lowest portion of the drawing, further, entwined with the needle threads 2 and 2 protruding on the rear face of a cloth so as to succeeding to the final loops 2*a* and 2*a* and is cut together with the needle threads 2 and 2 at the terminal cutting portion 3*a* which is returned to the left side of the drawing.

In the stitch structures shown in FIGS. 4 and 5, the looper thread 3 has another cutting portion 3*b* at a position different from the terminal cutting portion 3*a*.

In FIG. 4, the cutting portion 3*b* is provided at the right side between the final loops 2*a* and 2*a* and the preceding loops 2*b* and 2*b* adjacent to the sewing starting side of the respective final loops 2*a* and 2*a*. Namely, the stitches shown in FIG. 4 have the cutting portion 3*b* of the looper thread 3 at one side of the positions in which it is entwined in the mode of interlacing with the preceding loops 2*b* and 2*b* adjacent to the sewing starting side of the final loops 2*a* and 2*a* of the rows of thread loops 20 and 20.

In FIG. 5, the cutting portion 3*b* is provided at the right side between the preceding loops 2*b* and 2*b* and the preceding loops 2*c* and 2*c* adjacent to the sewing starting side of the respective preceding loops 2*b* and 2*b*. Namely, the stitches shown in FIG. 5 have the cutting portion 3*b* of the looper thread 3 at one side of the positions in which it is entwined in the mode of interlacing with the preceding loops 2*c* and 2*c* adjacent to the sewing starting side of the final loops 2*a* and 2*a* of the rows of thread loops 20 and 20, sandwiching the preceding loops 2*b* and 2*b*.

The stitch structures having the cutting portion 3*b* can be composed by a procedure of cutting the needle threads and the looper thread after carrying out the sewing motion of not one stroke but 2 strokes or 3 strokes in a state in which the looper thread is retained at the rear side of the looper, applying the method disclosed in the fore-mentioned Japanese Patent Publication No. 2879399 by the applicant of the present application.

Further, the stitch structures can be also composed by a procedure of manually cutting the middle portion of the looper thread 3 entwined with the rows of thread loops 20 and

20 after forming the stitches of general double chain stitches shown in FIG. 2, as described above, for example using a scissors, a knife and the like, not at the final loops 2*a* and 2*a*, but at one side of the preceding loops 2*b* and 2*b* or the preceding loops 2*c* and 2*c* (the reverse side of the terminal cutting portion 3*a*) which are closer to the sewing starting side than the final loops 2*a* and 2*a*.

In the stitch structures shown in FIGS. 4 and 5, when the terminal cutting portion 3*a* is pulled to a direction shown by an arrow in the drawings, the looper thread 3 continuing to the portion preceding to the terminal cutting portion 3*a* slips off from the final loops 2*a* and 2*a* of the rows of thread loops 20 and 20, but the slipping off occurs only at the fragment of the looper thread 3 until the intermediate cutting portion 3*b*, and there is no fear that raveling occurs in the looper thread 3 at a portion preceding to the cutting portion 3*b*.

Since the looper thread 3 at a portion preceding to the cutting portion 3*b* is entwined with the preceding loops 2*b* and 2*b* or the preceding loops 2*c* and 2*c* which are situated at a position closer to the sewing starting side than the final loops 2*a* and 2*a*, the looper thread 3 does not slip off from the preceding loops 2*b* and 2*b* or 2*c* and 2*c* even if the cutting portion 3*b* is pulled to a direction shown by an arrow in the drawing.

Further, the preceding loops 2*b* and 2*b* or 2*c* and 2*c* with which the looper thread 3 at a portion preceding to the cutting portion 3*b* is entwined are not likely to slack in comparison with the final loops 2*a* and 2*a*. Accordingly, even if external force to a direction shown by an outline arrow in FIG. 4 or 5 is acted, the looper thread 3 at a portion preceding to the cutting portion 3*b* can keep the entwinement with the preceding loops 2*b* and 2*b* or 2*c* and 2*c* and the occurrence of raveling can be effectively prevented.

Further, in the embodiments above, the cutting portion 3*b* of the looper thread 3 is provided at one side of the preceding loops 2*b* and 2*b* adjacent to the sewing starting side of the final loops 2*a* and 2*a*, or at one side of the preceding loops 2*c* and 2*c* adjacent to the final loops 2*a* and 2*a* sandwiching one of the preceding loops 2*b* and 2*b*, but the cutting portion 3*b* can be also provided at one side of the loops adjacent to the final loops 2*a* and 2*a* sandwiching 2 or more of loops.

Figure 6:
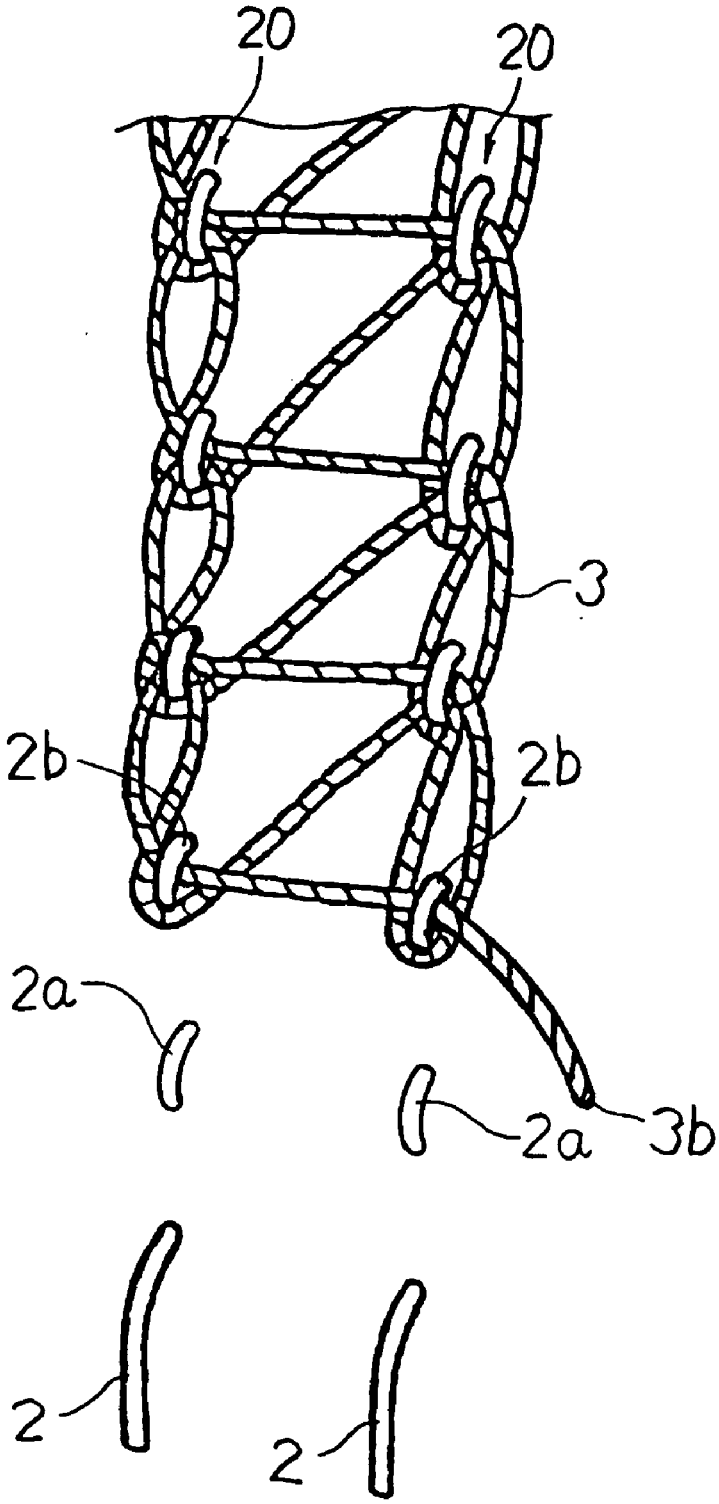
FIG. 6 is a plan view showing the modification example of the stitch structure of the first embodiment.

FIG. 6 is a plan view showing a modification example of the stitch structure of the first embodiment shown in FIG. 4. The drawing shows a state after the fragment of the looper thread 3 between the terminal cutting portion 3*a* and the cutting portion 3*b* falls off. In this case, as illustrated, the final loops 2*a* and 2*a* of the rows of thread loops 20 and 20 exist without causing entwinement with the looper thread 3 and the looper thread 3 is entwined in the mode of interlacing with the preceding loops 2*b* and 2*b* adjacent to the sewing starting side of the final loops 2*a* and 2*a*, to prepare the stitch structure in which the cutting portion 3*b* is situated at a portion protruding to the right side of the drawing. The stitch structure is also included in the scope of the present invention.

Figure 7:
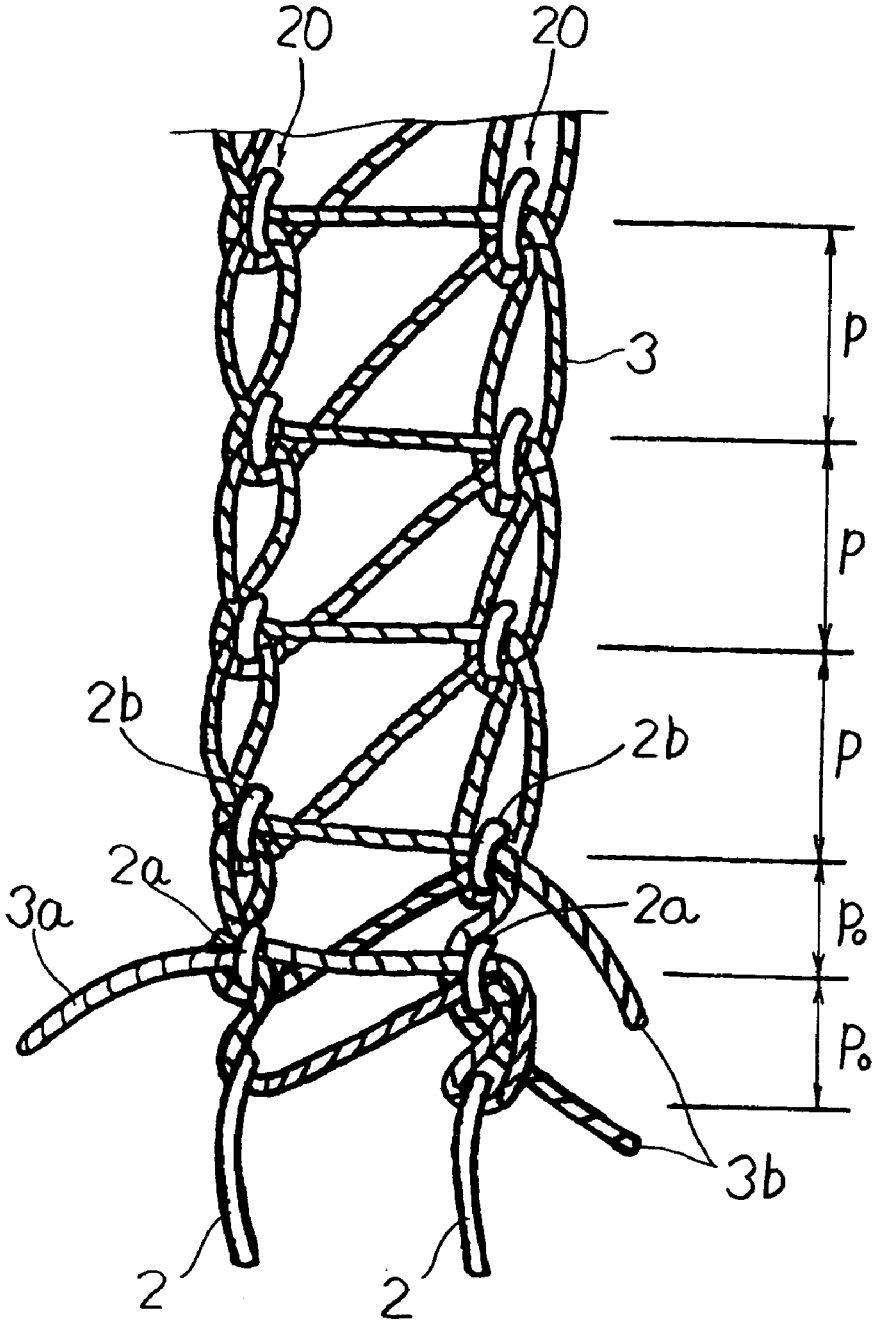
FIG. 7 is a plan view showing the third embodiment of the stitch structure related to the present invention.

FIG. 7 is a plan view showing the third embodiment of the stitch structure related to the present invention. The stitch structure shown in the present drawing has the cutting portion 3*b* of the looper thread 3 at one side of positions in which it is entwined in the mode of interlacing with the preceding loops 2*b* and 2*b* adjacent to the final loops 2*a* and 2*a*, in like manner as the stitch structure shown in FIG. 4, and further, the pitch $p_0$ between the preceding loops 2*b* and 2*b* and the final loops 2*a* and 2*a* is lessened than the pitch p between the loops closer to the sewing starting side than the preceding loops 2*b* and 2*b*. The sizing of the pitches can be realized by, for example, condensed stitches using a sewing machine equipped with feed control mechanism that is disclosed in Japanese Patent Publication No. 3673902 by the applicant of the present application.

Figure 8:
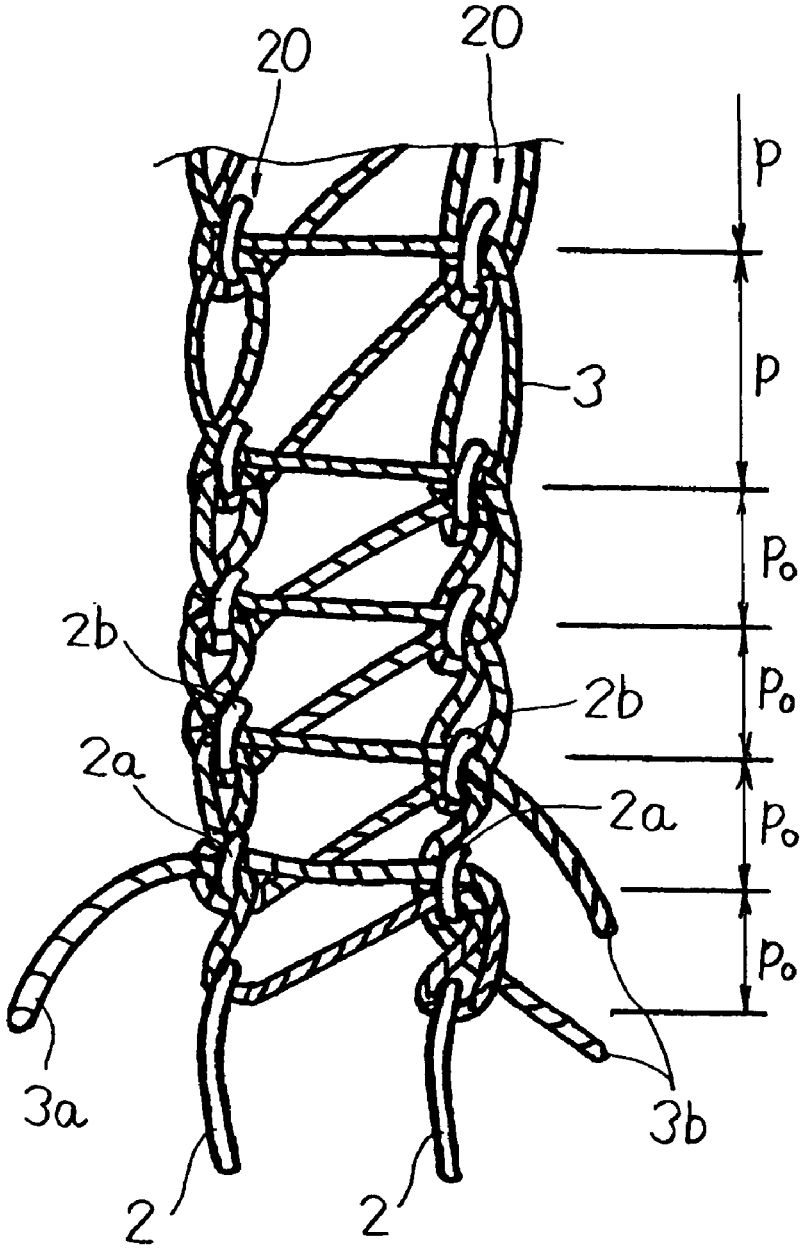
FIG. 8 is a plan view showing the fourth embodiment of the stitch structure related to the present invention.

FIG. 8 is a plan view showing the fourth embodiment of the stitch structure related to the present invention. In the present drawing also, a stitch structure is shown in which the cutting portion 3*b* of the looper-thread 3 is provided at one side of the positions in which it is entwined with the preceding loops 2*b* and 2*b* adjacent to the final loops 2*a* and 2*a*, in the mode of interlacing, in like manner as the third embodiment shown in FIG. 7, and the condensed stitches are carried out in combination.

In the fourth embodiment shown in FIG. 8, the condensed stitches are carried out within a range which is expanded by a plural number of stitches (2 stitches in the drawing) to the sewing starting side than the preceding-loops 2*b* and 2*b*, differing from the third embodiment shown in FIG. 7. The pitch by 2 stitches not only between the preceding loops 2*b* and 2*b* and the final loops 2*a* and 2*a* but also between the loops closer to the sewing starting side than the preceding loops 2*b* and 2*b* are set as $p_0$ and is lessened than the pitch p between the loops closer to the sewing starting side than the preceding loops 2*b* and 2*b*.

The condensed stitches carried out in the third and fourth embodiments is known as one effective means for reinforcing the entwinement of the needle threads 2 and 2 with the looper thread 3 and preventing the occurrence of raveling. In the third embodiment, it is possible to prevent the falling out of the looper thread 3 remaining in the segment from the cutting portion 3*b* to the terminal cutting portion 3*a*. In the fourth embodiment, the falling out of the fragment can be prevented, the entwinement of the looper thread 3 at a position closer to the sewing starting side than the cutting portion 3*b* is reinforced and the occurrence of raveling can be further surely prevented.

The falling out of the fragment of the looper thread 3 does not affect the keeping of the stitch structure of double chain stitches, but when the falling out occurs during the use of a sewn product, it causes unnecessary concern in a user about the quality of the sewn product. The prevention of the falling out of the fragment realized by the third and fourth embodiments is useful for the quality improvement of sewn products.

Figure 9:
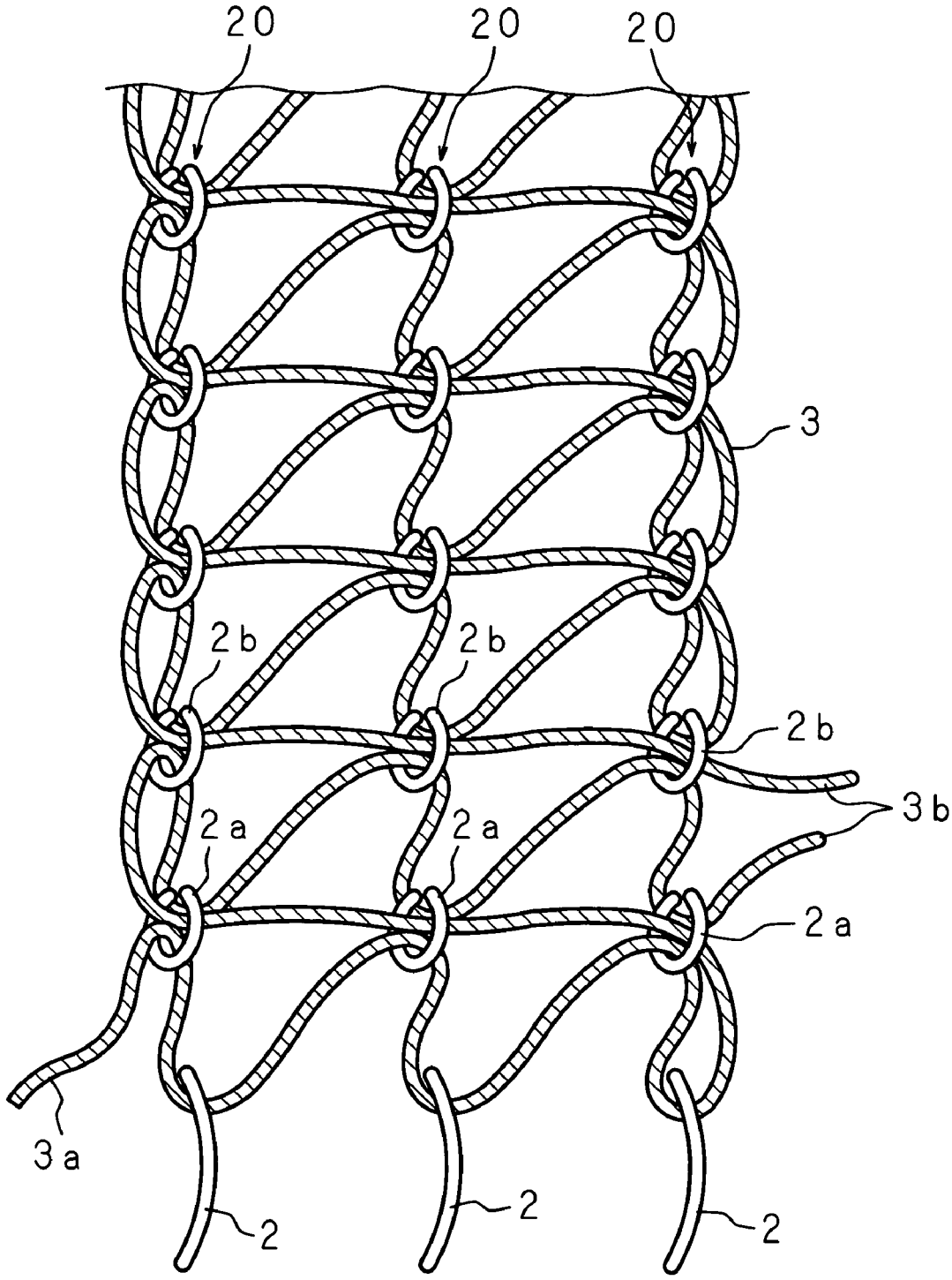
FIG. 9 is a plan view showing the fifth embodiment of the stitch structure related to the present invention.
Figure 10:
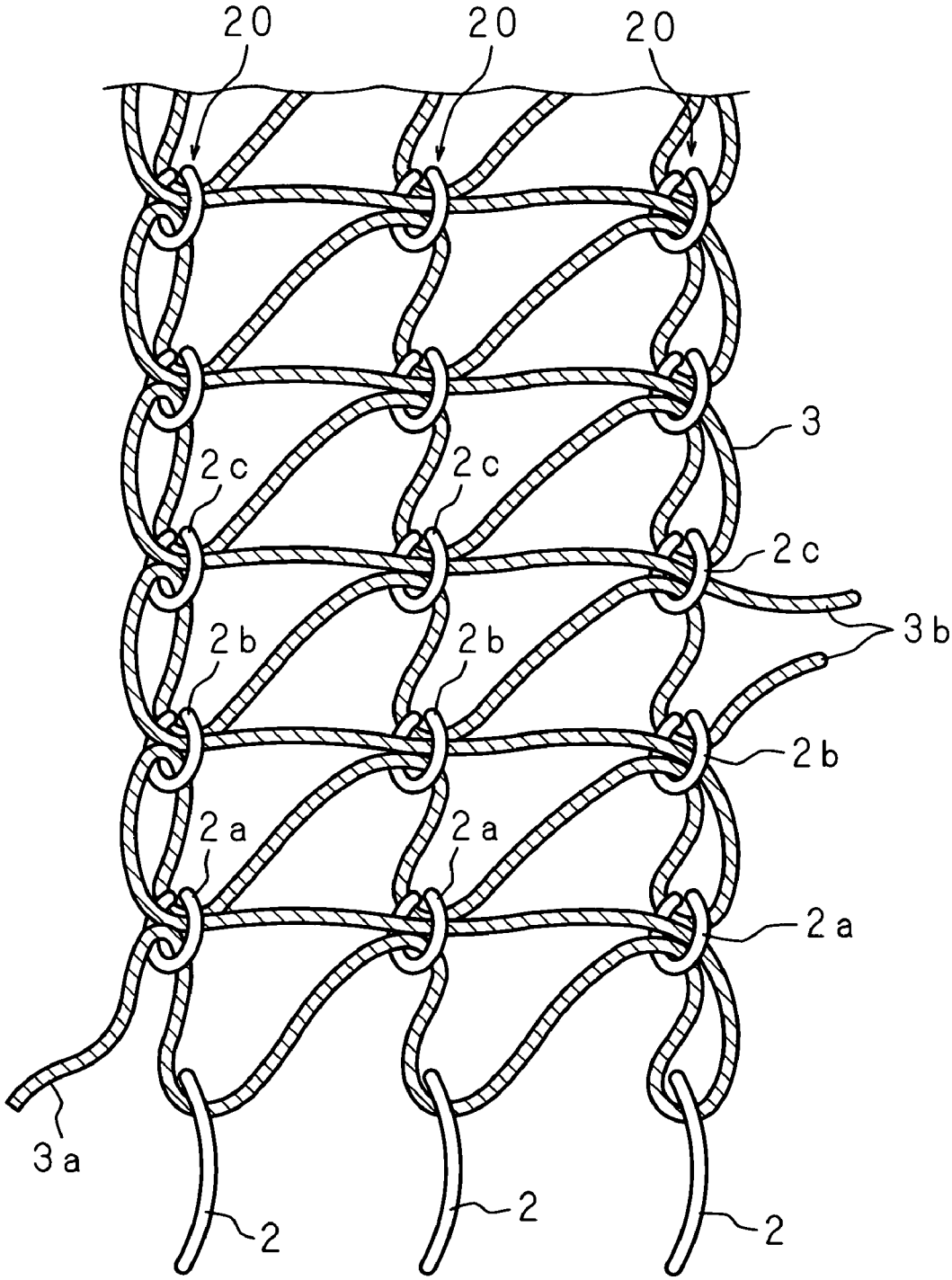
FIG. 10 is a plan view showing the sixth embodiment of the stitch structure related to the present invention.

FIG. 9 is a plan view showing the fifth embodiment of the stitch structure related to the present invention. FIG. 10 is a plan view showing the sixth embodiment of the stitch structure related to the present invention. FIGS. 9 and 10 show the embodiments in the double chain stitches with 3 needles and the looper thread 3 is entwined with the respective loops of the three rows of thread loops 20, 20 and 20 that are formed by the three needle threads 2, 2 and 2 and arranged mutually in parallel, by the mode of interlooping and the mode of interlacing.

In FIG. 9, the looper thread 3 is cut at one side of the positions in which it is entwined in the mode of interlacing with the preceding loops 2*b*, 2*b* and 2*b* adjacent to the sewing starting side of the final loops 2*a*, 2*a* and 2*a* of the rows of thread loops 20, 20 and 20, in like manner as the stitch structure of FIG. 4 using two needles.

In FIG. 10, the looper thread 3 is cut at one side of the positions in which it is entwined in the mode of interlacing with the preceding loops 2*c*, 2*c* and 2*c* adjacent at an interval to the sewing starting side of the final loops 2*a*, 2*a* and 2*a* of the rows of thread loops 20, 20 and 20, in like manner as the stitch structure of FIG. 5 using two needles.

In the stitch structures shown in FIGS. 9 and 10 also, the occurrence of raveling can be effectively prevented in quite a similar manner as in the stitch structure shown in FIGS. 4 and 5 using 2 needles. Further, in like manner as FIG. 6 using 2 needles, these embodiments include also a modification mode in which the segment of the looper thread 3 from the cutting portion 3*b* to the terminal cutting portion 3*a* falls out. Further, the stitch structure in which the interloop pitch is changed using the condensed stitches in combination can be composed in like manner as FIGS. 7 and 8 using 2 needles.

As cleared from the detailed illustration above, since the looper thread is cut at one side of the preceding loop in which slack is less liable to occur than in the final loop at the sewing termination end in the stitch structure related to the present invention, the slipping out of the looper thread by the action of external force does not occur, even if the double chain stitches are carried out under weak imparting tension using smooth needle threads, therefore the occurrence of raveling peculiar to the stitches can be effectively prevented and it can contribute to the quality improvement of sewn products.

Further, in the stitch structure related to the present invention, since the interloop pitch between the preceding loops retaining the cutting portion of the looper thread and the sewing termination end, or between a loop which is one or more loops previous to the preceding loop and the sewing termination end is lessened than the interloop pitch between the loops at other portions, the entwinement of the looper thread with the needle threads is reinforced at the portions preceding to the cutting portion and at a portion preceding to the cutting portion; therefore the slipping out of the fragment the looper thread and the occurrence of raveling caused by the slipping out can be more surely prevented.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A stitch structure of double chain stitches comprising: a plural number of needle threads penetrating a cloth and respectively forming rows of thread loops at the rear face of the cloth; and one looper thread entwined with the rows of thread loops at the rear face of the cloth;

wherein the looper thread is cut at one side of positions at which the looper thread is entwined in the mode of interlacing with preceding loops adjacent to final loops at the respective sewing termination ends of the plural number of rows of thread loops or the preceding loops adjacent to the final loops at an interval.

2. The stitch structure according to claim 1, wherein the looper thread is entwined between the final loops and the preceding loops and cut at both ends.

3. The stitch structure according to claim 1, wherein pitch between the final loops and the preceding loops is smaller than a pitch between loops previous to the preceding loops.

4. The stitch structure according to claim 2, wherein a pitch between the final loops and the preceding loops is smaller than a pitch between loops previous to the preceding loop.

5. The stitch structure according to claim 1, wherein a pitch between the final loops and the preceding loops and at least one pitch between loops previous to the preceding loops are smaller than pitches between loops further previous to the preceding loop.

6. The stitch structure according to claim 2, wherein a pitch between the final loops and the preceding loops and at least one pitch between loops previous to the preceding loop are smaller than pitches between loops further previous to the preceding loop.

* * * * *